United States Patent [19]

Kobler

[11] Patent Number: 4,739,702

[45] Date of Patent: Apr. 26, 1988

[54] OSCILLATION-SUPPRESSED PRINTING CYLINDER

[75] Inventor: Ingo Kobler, Anhausen, Fed. Rep. of Germany

[73] Assignee: M.A.N. Roland Druckmaschinen Aktiengesellschaft, Augsburg, Fed. Rep. of Germany

[21] Appl. No.: 893,034

[22] Filed: Aug. 4, 1986

[30] Foreign Application Priority Data

Aug. 2, 1985 [DE] Fed. Rep. of Germany ..... 3527711

[51] Int. Cl.[4] ..... B41F 13/08

[52] U.S. Cl. ..... 101/216; 29/110; 29/129

[58] Field of Search ..... 101/216; 74/574; 29/110, 129

[56] References Cited

U.S. PATENT DOCUMENTS

| | | | |
|---|---|---|---|
| 3,521,340 | 7/1970 | Gallant et al. | 74/574 |
| 4,207,957 | 6/1980 | Sivers et al. | 74/574 |
| 4,254,985 | 3/1981 | Kirschner | 74/574 |
| 4,313,577 | 2/1982 | Peters | 74/574 |
| 4,332,194 | 6/1982 | Gensheimer | 101/216 |
| 4,487,123 | 12/1984 | Kobler et al. | 101/216 |

FOREIGN PATENT DOCUMENTS

| | | | |
|---|---|---|---|
| 3025799 | 1/1982 | Fed. Rep. of Germany | 29/110 |

*Primary Examiner*—Edgar S. Burr
*Assistant Examiner*—Huong Q. Pham
*Attorney, Agent, or Firm*—Frishauf, Holtz, Goodman & Woodward

[57] ABSTRACT

Some conventional printing cylinders include therein a damping system having springs which receive oscillation forces transmitted from the cylinder wall, for example by cross bars, disks, or the like, to dampen oscillations occurring upon roll-off of an axial clamping groove formed in the cylinder against an engagement cylinder. To reduce not only bending and torsional oscillations, but also the effect of the impact shock when the groove rolls off against the engagement cylinder, impact positions are defined within the cylinder against which either the damping springs or elements coupled to the damping springs can engage the cylinder upon deflection thereof due to the impact shock so that the resulting elastic shock or impact is likewise transferred to the damping springs of the damping system. The damping system includes oscillation transferring rods, bars, or the like which may be embedded or at least in part contacted by elastic materials, such as foam or the like.

12 Claims, 2 Drawing Sheets

Fig. 1
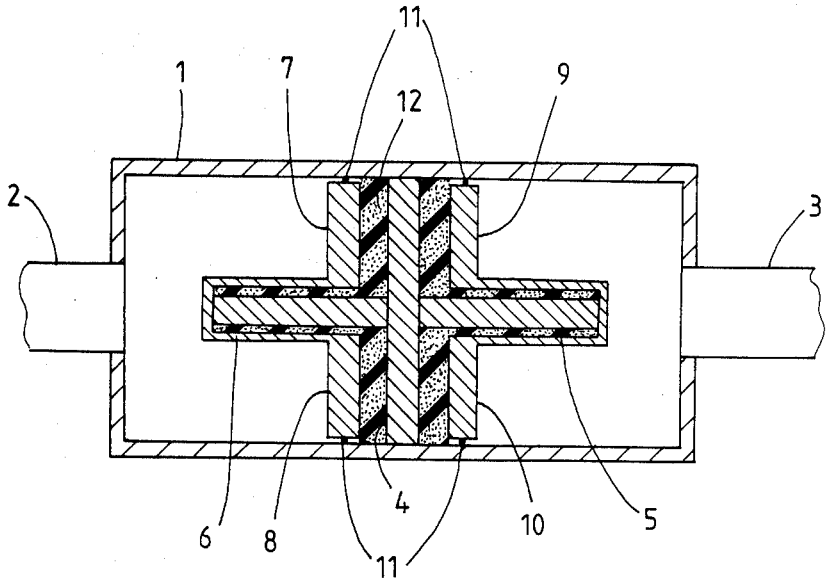
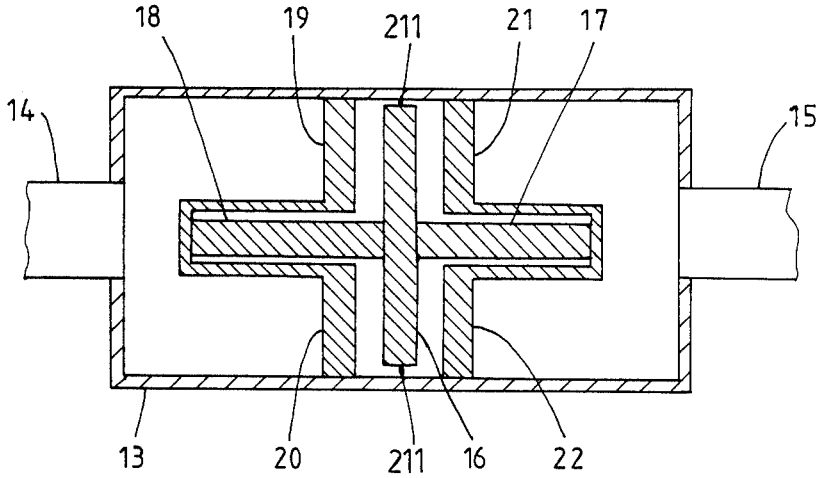
Fig. 2

OSCILLATION-SUPPRESSED PRINTING CYLINDER

Reference to related patent, assigned to the assignee of the present invention, the disclosure of which is hereby incorporated by reference:
U.S. Pat. No. 4,487,123 Kobler et al.

The present invention relates to the structure of a printing machine cylinder which is so constructed that oscillations in rotary and bending direction which occur as a clamping groove runs off against another cylinder are damped by a damping element which is located within the cylinder jacket or cylinder housing, and which is excited upon being subjected to impacts or blows which occur upon such run-off of the clamping grooves of the cylinder.

BACKGROUND

U.S. Pat. No. 4,487,123 Kobler et al describes a printing cylinder which is construeted with an arrangement to reduce bending oscillations upon run-off of clamping grooves against an engaged cylinder. The apparatus includes impact transmission elements located at the interior of the cylinder, secured to the interior of the cylinder. The impact transmission elements may include rods or bars or the like secured to the inside of the cylinder wall. They extend, for example, diametrically across the cylinder. Oscillations which occur when the cylinder grooves run off against another cylinder are transferred to an absorber rod extending parallel to the cylinder groove. The absorber rod is surrounded with a damping mass. Propeller-like vanes or blades are secured to the ends of the absorber rods to suppress rotary oscillations.

The system is specifically designed and operates well by suppressing on-going oscillations of the cylinder, both with respect to bending as well as with respect to torsional oscillations.

THE INVENTION

It is an object to improve a printing cylinder of the type described, that not only oscillations which occur are absorbed by damping the oscillations, but, additionally, to decrease the effects of elastic impacts or blows which occur directly upon roll-off of the cylinder grooves against a matching cylinder. Blows can be absorbed by transferring the impacts to impact transmission elements, preferably the very same elements already present to also suppress the oscillations.

An impact position is formed or defined within the interior of the cylinder with respect to and against the damping system which is already present, to provide for direct transfer of cylinder wall deflections due to blows or impacts which arise when the cylinder groove rolls off against another cylinder. Under normal, undeformed operation of the cylinder, a space, or clearance between the cylinder wall and the impact transmission element or elements will remain.

DRAWINGS

FIG. 1 shows, in highly schematic representation, a longitudinal cross section through a printing machine cylinder, including the damping systems and its elements, and the arrangement thereof within the interior of the cylinder;

FIG. 2 is a view similar to FIG. 1, showing another embodiment;

DETAILED DESCRIPTION

Figure 3:
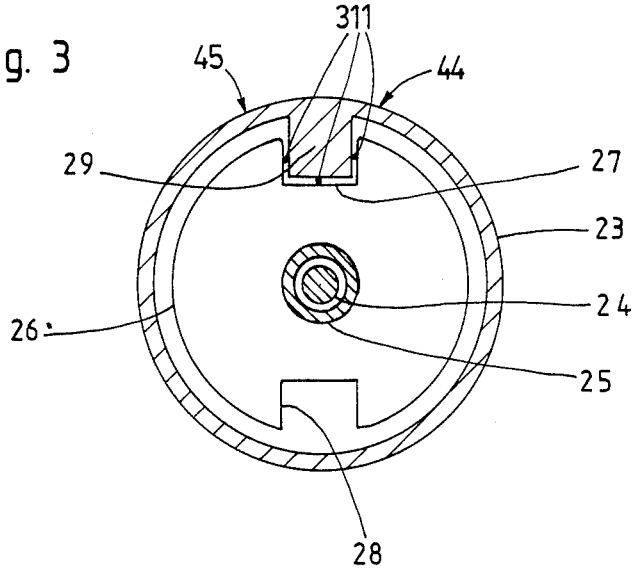
FIG. 3 is a transverse cross-sectional view of a damping system in accordance with the present invention.

FIG. 1 illustrates, in longitudinal section, and highly schematically, a printing machine cylinder which is formed with an axial groove—not further shown in FIG. 1—for example to accomodate clamping elements or grippers to clamp a printing plate, or a rubber or similar blanket for offset printing or the like. The groove and the gripper elements can all be of standard and well known construction of any suitable type.

The printing cylinder shown in FIG. 1, as known, includes an outer cylinder jacket and two cylinder stub shafts 2, 3 which can be journaled in suitable bearings in the side walls of the printing machine. The bearing arrangement and drive gears and so on have been omitted and can all be conventional.

Oscillations induced in the cylinder upon roll-off of the cylinder groove (not shown in FIG. 1) against another engaged cylinder—likewise not shown—are of maximum amplitude in the center of the cylinder. To suppress such oscillations, a damping system is provided, which includes a transverse bar or rod 4 located in the cylinder, and, forming an oscillation transmission element. The bar or rod 4 is secured with its two ends to the wall of the cylinder 1. The bar or rod 4 transfers oscillations which arise upon roll-off of the cylinder groove against another cylinder to damping elements 7, 8, 9, 10. Preferably, and in accordance with the embodiment shown in FIG. 1, the bar 4 is secured to axially extending cross arms 5, 6. The damping elements preferably are formed by rotation absorbing and bending force-absorbing springs. As best seen in FIG. 1, the damping elements 7, 8 and 9, 10, respectively, are located symmetrically with respect to the two sides of the oscillation transfer bar 4. The damping elements 7–10 are generally L-shaped. One leg of the L is connected to the ends of the cross arms 5, 6.

In accordance with a feature of the invention, the other branch of the L, namely the arms of the damping elements 7–10 extending diametrically across the cylinder, terminate just short of the inner wall of the printing cylinder. An impact position 11 is thus defined by the small space between the respective damping element 7, 8, 9, 10 and the inner wall of the cylinder.

Operation: When the cylinder groove runs off against another cylinder, an elastic impact will be transferred and the cylinder wall at the impact positions 11 will engage the damping elements 7–10 which, as noted, are provided in the form of springs accepting rotary and bending forces. The impact will, thus, be transferred to the springs 7–10, resulting in damping especially of the very first occurring oscillation excursion or, in other words, the initial undulation, at the base frequency, both with respect to bending as well as with respect to rotation. The damping elements 7–10 are embedded in elastic material 12 to enhance the damping effect.

The printing cylinder, in accordance with the invention, thus provides for transfer of rotary and bending oscillations to the damping elements 7–10 by the bar 4 and the cross bars or cross rods 5 and 6 for absorption of oscillations in general; additionally, and in accordance with the invention, impacts are transferred to the damping elements 7 to 10 over the impact positions 11, to provide for damping of the direct impacts which occur due to the roll-off of the groove.

FIG. 2 illustrates another embodiment of the cylinder wall deflection or impact transmission arrangement; the damping elements are somewhat differently constructed and an impact transmission element is provided. The cylinder jacket 13 is journalled via stub shafts 14, 15. Differing, however, from the embodiment of FIG. 1, impact position 211 are arranged between the cylinder wall and a centrally located bar 16, forming the impact transmission element. The bar 16 is positioned in the center of the cylinder, and terminates with its end closely beneath the inner wall surface of the cylinder jacket 13 at impact positions 211. Transfer cross rods or bars 17–18 are secured to the bar 16 to transfer impacts and oscillations to the damping elements 19, 20, 21, 22. Similar to the embodiment of FIG. 1, the arms 17, 18 are surrounded by the damping elements 19–22. The damping elements may, for example, be tubular, as shown. The transversely extending legs of the L-shaped damping elements 19–22 are directly connected to the interior surface of the cylinder jacket 13.

Operation, FIG. 2: normally, positioned in the desired location in the interior of the cylinder. Oscillations within the cylinder are transferred via the legs of the damping elements 19–22 which are secured to the cylinder wall. Impact oscillations, which occur during roll-off of a cylinder groove against another cylinder are transferred to the damping elements 19–22 via the impact positions 211 and bar 16.

FIG. 3 illustrates a particularly desirable construction, in transverse cross section, in which the cylinder groove has been omitted from the cylinder 23 for clarity and ease of illustration.

The cylinder jacket 23 encloses damping elements 24 and 25 located, preferably, centrally within the cylinder. An impact and/or oscillation transmission element, in form of a disk 26, is located within the cylinder, secured to the damping elements 24, 25. A plurality of such disks 26 can be located within the cylinder, the damping elements extending axially therethrough. The interior of the cylinder wall is formed with impact transfer projections 29. The disk or disks 26 are formed with openings, or cut-outs 27, 28, fitting around the projections 29. Only one such projection is shown in FIG. 3, another one, located diametrically oppositely having been omitted from the drawing for clarity. The openings 27, 28 in the disks are slightly greater than the internally extending projections 29, to leave small clearance spaces forming the impact transmission positions 311. As best seen in FIG. 3, a plurality of impact transmission positions will be formed to transmit from the cylinder jacket 23 to the disk 26 rotary impacts as well as radially occurring impacts, the rotary impacts being transmitted at the lateral sides of the projections 29, and the radial impact at the diametrical side thereof. The damping elements 25 may, of course, also receive oscillations transferred thereto over bars and rods which are directly coupled to the wall of the cylinder, for example by additional disks 26 or by bars similar to the bar 4 (FIG. 1). It is essential that, in circumferential direction, the transfer elements are located below or beside the cylinder groove. Thus, in FIG. 3, the cylinder groove is located on the left side or on the right side of the projections 29.

Figure 4:
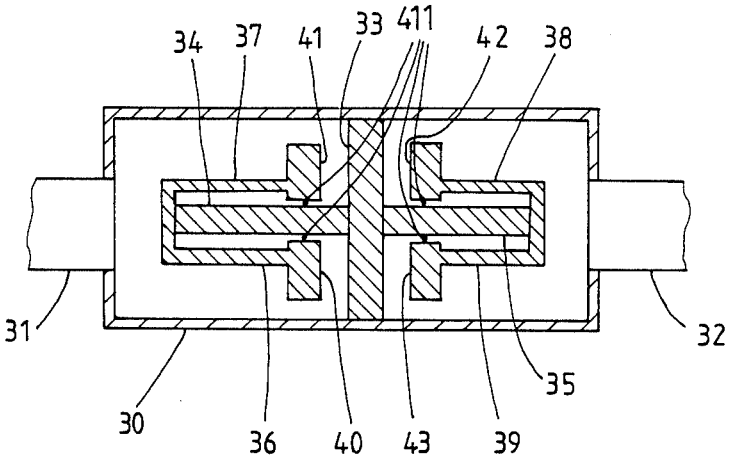
FIG. 4 is a longitudinal schematic sectional view of other forms of a damping system in accordance with the present invention.

FIG. 4 illustrates a further embodiment of the cylinder in accordance with the invention. A cylinder jacket 30 is coupled to stub shafts 31, 32. A transfer element 33 is secured to the interior of the cylinder wall. Transfer element 33 is, in turn, coupled to elongated transmission arms or bars 34, 35 extending, preferably axially, within the cylinder. Damping elements 36, 37, 38, 39 receive oscillations being transferred from the cylinder wall via the bar 33 to the elongated bars 34, 35. The damping elements are directly connected at the terminal portions to the elongated bars 34, 35. Additionally, the damping elements 36–39 are formed with impact accepting elements 40, 41, 42, 43, respectively which may be hammer-like. Impact transmission positions 411 are formed between the respective impact accepting elements 40–43 and the respective sides of the axially extending bars 34, 35, as best seen in FIG. 4. Blows and impacts are transmitted to the impact transmission positions over the same path formed by the bar 33 and the bar elements 34, 35 as are oscillations which are damped by the damping elements 36–39 coupled to the bars 34, 35, respectively. The damping elements 36–39 are excited, that is, receive oscillations which are to be damped, preferably directly from the center or midpoint of the cylinder via the bar 33. The impact transmission positions 411 are preferably located as close to the center of the cylinder as possible, although this is not a necessary requirement; they can be located at different points, for example spaced somewhat from a median position.

Arrangements for acceptance and damping of torsional as well as bending oscillations thus are combined with an apparatus for also accepting and damping elastic impacts or elastic blows. The damping elements which form vibration or oscillation absorbers are preferably located in the center of the cylinder, which is subject to the widest excursion upon impact; this, also, is the preferred place for locating the impact positions which tranfer the elastic blow or elastic impact to the damping system.

FIG. 1 illustrates additional damping material, for example foam material, which is coupled to the damping elements 7–10. Such foam material has been omitted from the showing in FIGS. 2–4 for clarity of the drawing. Of course, such additional foam material 12 can be applied in all the embodiments by embedding the respective damping elements in foam damping material, formed for example by elastic foam or the like.

Various changes and modifications may be made, and features described in connection with any one of the embodiments may be used with any of the others, within the scope of the inventive concept.

I claim:

1. Oscillation-suppressed hollow printing cylinder having a cylinder wall;

an axial groove in the cylinder wall for clamping of a surface cover on the cylinder, oscillation suppression means for suppressing oscillations arising upon rolling off of said groove over an engagement cylinder, said oscillation suppressing means comprising:

damping elements and a bar member located within the inside of the cylinder, said bar member having associated cross members, and elastic material interconnecting said damping elements, said bar member and said cross members, one of said damping elements or said bar member contacting the inner wall of said cylinder and the other of said damping elements and said bar member being normally spaced from the inner wall of said cylinder to define at least one impact position, said impact position transferring cylinder wall deflections arising upon roll-off of the groove over said engagement cylinder or due to other impacts to said damping elements for supression.

2. The cylinder of claim 1, wherein said bar member is a diametrically extending part (4, 16) located within the cylinder, said cross members (5, 6, 17, 18) extend axially from said bar member, and said damping elements; and wherein said elastic material comprises resilient means providing spring force in rotary and bending direction, coupled to said cross members (5, 6).

3. The cylinder of claim 1, wherein said bar member is a diametrically extending part (4, 16) located within the cylinder, said cross members (5, 6; 17, 18) extend axially from said bar member, and said damping elements; and the damping elements (7–10; 19–22) are generally L-shaped, each damping element having two legs, one leg each being coupled to a respective cross member.

4. The cylinder of claim 3, wherein (FIG. 1) another leg of the respective L-shaped damping elements terminates just short of the inner wall of the cylinder (1) to define, with the adjacent zone of the cylinder, said impact position (11).

5. The cylinder of claim 3, wherein (FIG. 2) the damping elements (19–22) are coupled to the inner wall of the cylinder;

and the diametrically extending part (16) terminates just short of the inner wall of the cylinder to define, with an opposite zone of the inner wall of the cylinder, said impact position (211).

6. The cylinder of claim 1, wherein said bar member is located generally diametrically across and at a median position within the cylinder;

said elastic material being connected to said bar at both sides thereof, and secured to the inside of the cylinder wall;

and wherein said diametrically extending bar terminates just short of the inner surface of the wall of the cylinder to define, with the region opposite the bar, said impact position (211).

7. The cylinder of claim 1, wherein said elastic material includes foam damping material (12) at least in part contacting the damping elements.

8. Oscillation suppressed hollow printing cylinder having a cylinder wall;

an axial groove in the cylinder wall for clamping of a surface cover on the cylinder, oscillation suppression means for suppressing oscillations arising upon rolling off of said groove over an engagement cylinder, said oscillation suppressing means comprising a bar element (33) secured to the inner wall (30) of the cylinder and extending essentially diametrically thereacross;

transmission arms (34, 35) extending approximately axially within the cylinder and coupled to said bar element (33);

elongated damping elements (36–39) coupled to said transmission arms (34, 35) at one end and extending toward, but spaced from said transmission arms and defining, with the regions or zones on said transmission arms opposite said damping elements, a plurality of impact positions (411) to dampen oscillations upon deformation of the cylinder wall as a consequence of an oscillation due to impacts or blows transmitted from the cylinder wall via the impact position to the damping elements and for transfer of cylinder wall deflections arising upon roll off of the groove over said engagement cylinder to the damping elements.

9. The cylinder of claim 8, wherein the damping elements comprise resilient means secured to end portions of said transmission arms (34, 35) and extending axially towards the center of the cylinder, and impact accepting elements forming hammer-like elements (40–43) are provided, secured at the inner ends of the resilient means and facing said regions or zones of said transmission arms, with clearance at said impact positions (411).

10. The cylinder of claim 8, further including foam damping material (12) at least in part contacting the damping elements.

11. Oscillation-suppressed hollow printing cylinder having a cylinder wall;

an axial groove in the cylinder wall for clamping of a surface cover on the cylinder, oscillation suppression means for suppressing oscillations arising upon rolling off of said groove over an engagement cylinder, said oscillation suppressing means comprising damping elements (24, 25) located within the inside of the cylinder coupled to the cylinder;

an impact transmission element which comprises at least one disk element (26) extending essentially transversely across the interior of the cylinder coupled to said damping elements (24, 25) and having a generally circular outer configuration formed with recesses (27, 28) therein at the circumference thereof; and wherein the interior of the cylinder wall (23) is formed with inwardly extending projections fitting into said recesses with clearance to space the projections from said recesses and form circumferential and radial impact positions (311) so that the zones between said disk element and said inwardly extending projection formed by the clearance define the impact positions (311) to dampen oscillations upon deformation of the cylinder wall as a consequence of an oscillation due to impact or blows transmitted from the cylinder wall via the impact position to the damping elements and for direct transfer of cylinder wall deflections arising upon roll-off of the groove over said engagement cylinder, to the damping elements.

12. The cylinder of claim 11 wherein said damping elements includes foam damping material at least in part contacting the damping elements.

* * * * *